US005634616A

United States Patent [19]

Wang et al.

[11] Patent Number: 5,634,616

[45] Date of Patent: Jun. 3, 1997

[54] REMOVABLE AUTOMATIC TRIPOD LEGS FOR GOLF BAGS

[76] Inventors: Jessie L. Wang, 46980 Ocotillo Ct., Fremont, Calif. 94539; Tae G. Kim, 346-12 Myong Il-Dong, Kang-Dong Ku, Seoul, Rep. of Korea

[21] Appl. No.: 428,728

[22] Filed: Apr. 25, 1995

[51] Int. Cl.[6] ..... A63B 55/06

[52] U.S. Cl. ..... 248/96; 248/171; 206/315.7

[58] Field of Search ..... 248/96, 169, 170, 248/171; 206/315.3, 315.7

[56] References Cited

U.S. PATENT DOCUMENTS

| | | | |
|---|---|---|---|
| 4,834,235 | 5/1989 | Solheim et al. | 206/315.7 |
| 5,154,377 | 10/1992 | Suk | 248/96 |
| 5,156,366 | 10/1992 | Anderson | 248/96 |
| 5,236,085 | 8/1993 | Quellais | 248/96 |
| 5,339,951 | 8/1994 | Chen | 206/315.7 |
| 5,340,063 | 8/1994 | Hsieh | 248/96 |
| 5,351,921 | 10/1994 | Chen | 248/96 |

*Primary Examiner*—Derek J. Berger
*Assistant Examiner*—Anita M. King
*Attorney, Agent, or Firm*—Linval B. Castle

[57] ABSTRACT

A tripod assembly for attachment to a golf bag includes two legs in a pivotal mount high on the bag which pivot out to form a tripod using the bag as one leg. The legs are controlled by a shoe attached to the ends of long spring rods coupled to the legs and a tilting of the bag lifts the shoe and spring rods to pivot out the legs. The legs are automatically returned to their position close to the bag when the bag is returned to the upright or lifted. The legs, springs and shoe are very quickly and easily removed for storage.

3 Claims, 5 Drawing Sheets

REMOVABLE AUTOMATIC TRIPOD LEGS FOR GOLF BAGS

This invention relates generally to golf equipment and in particular to a novel tripod attachment for a golf bag that has automatically retractable legs which can be easily removed and stored in the golf bag.

BRIEF SUMMARY OF THE INVENTION

Many golfers prefer the golf cart for carrying and wheeling around the golf bag, raingear and sundry extras, but most golfers enjoy the flexibility and convenience in carrying their bags. Those who carry their bags, however, find it distasteful and awkward to lay their bags down on damp grass while they make a shot in the fairway or on the putting green because the bag gets wet, dirty and heavier with water which rubs off on their clothes as the game progresses.

The answer is to prop up the bag as if it were in a golf cart, using tripod legs. Tripod legs must be rugged yet lightweight so that the total weight of the bag with clubs is not materially increased. And it would be most convenient if the tripod legs were easily removable and could be stored in the bag with the clubs for convenience in storing and in traveling. Furthermore, it would be ideal if the tripod legs were automatically retractable when the bag was picked up and would extend automatically when the bag was set down.

The invention herein is for automatically extendible and retractable tripod legs which are rugged but lightweight and which can quickly and easily be removed for storage within the golf bag.

BRIEF DESCRIPTION OF THE DRAWINGS

In the drawings which illustrate the preferred embodiment of the invention.

DETAILED DESCRIPTION

Figure 1:
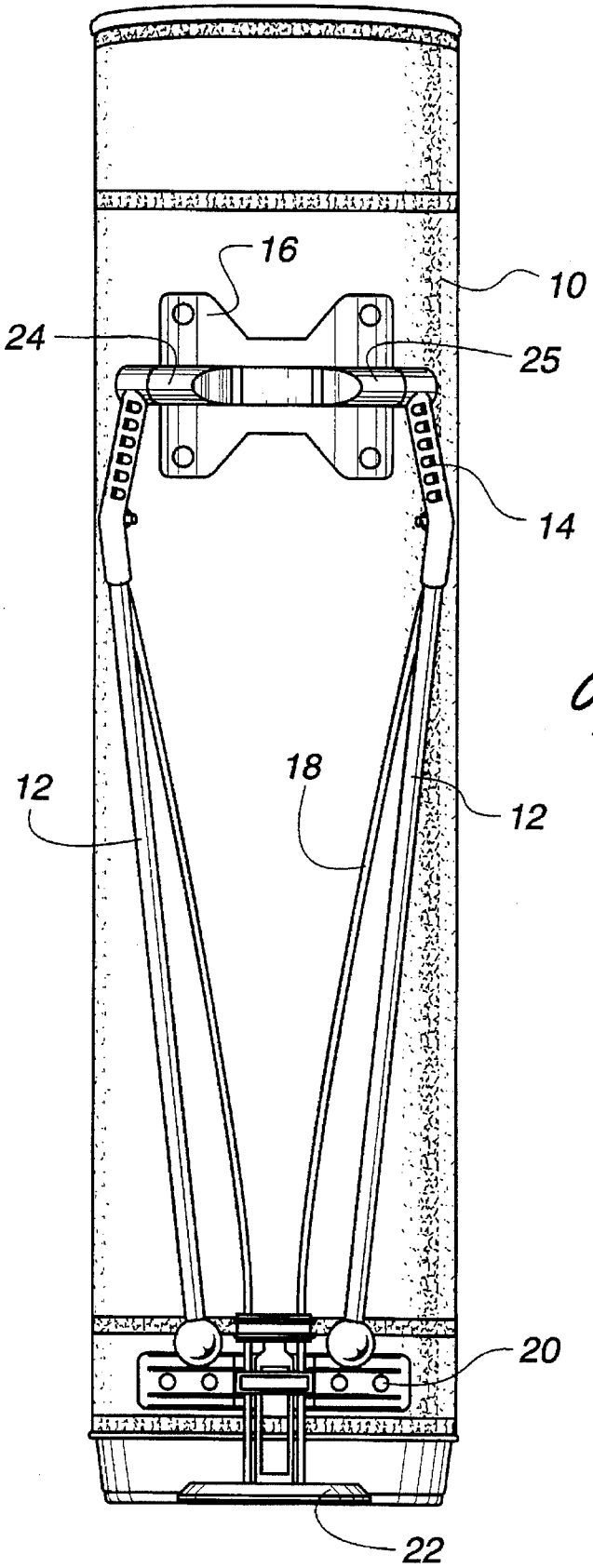
FIG. 1 is an elevational view showing a golf bag with retracted tripod legs.

Illustrated in FIG. 1 is a golf bag 10 equipped with the tripod legs 12 of the invention. The legs are attached to the bag 10 at the upper end where the legs are secured to an upper end casting 14 having a right angled tubing that enters an angled socket in the upper end assembly 16 which is riveted to the golf bag.

Normally, the legs 12 are held in the position shown in FIG. 1 by two long springs 18 the upper ends of which are hook into the each casting 14 and which extend down and, after passing through the T-block 20 which is also riveted to the bag, terminate in the shoe 22 the bottom surface of which is flush with the bottom surface of the golf bag 10 while the bag is standing as shown.

Figure 3:
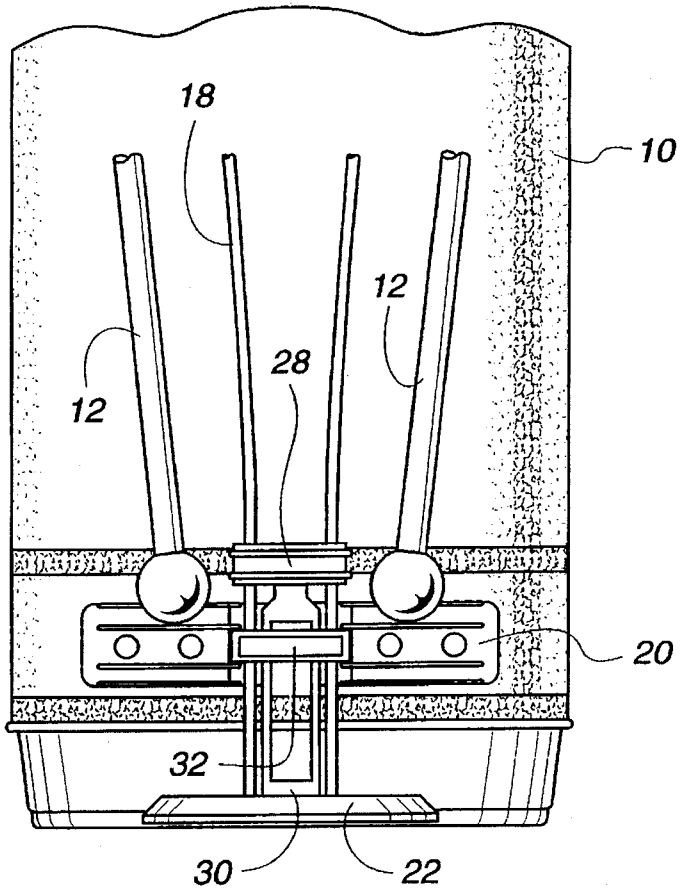
FIG. 3 is a detailed view of the lower end of the tripod legs.
Figure 2:
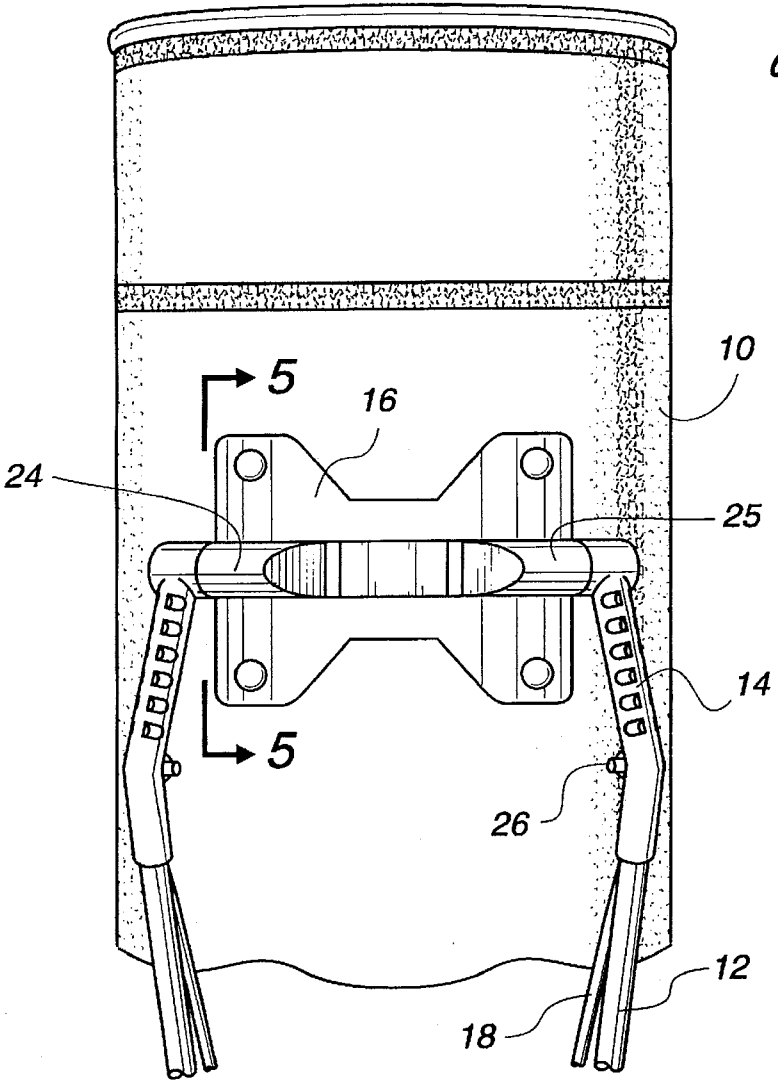
FIG. 2 is a detailed view of the upper end of the tripod legs.
Figure 10:
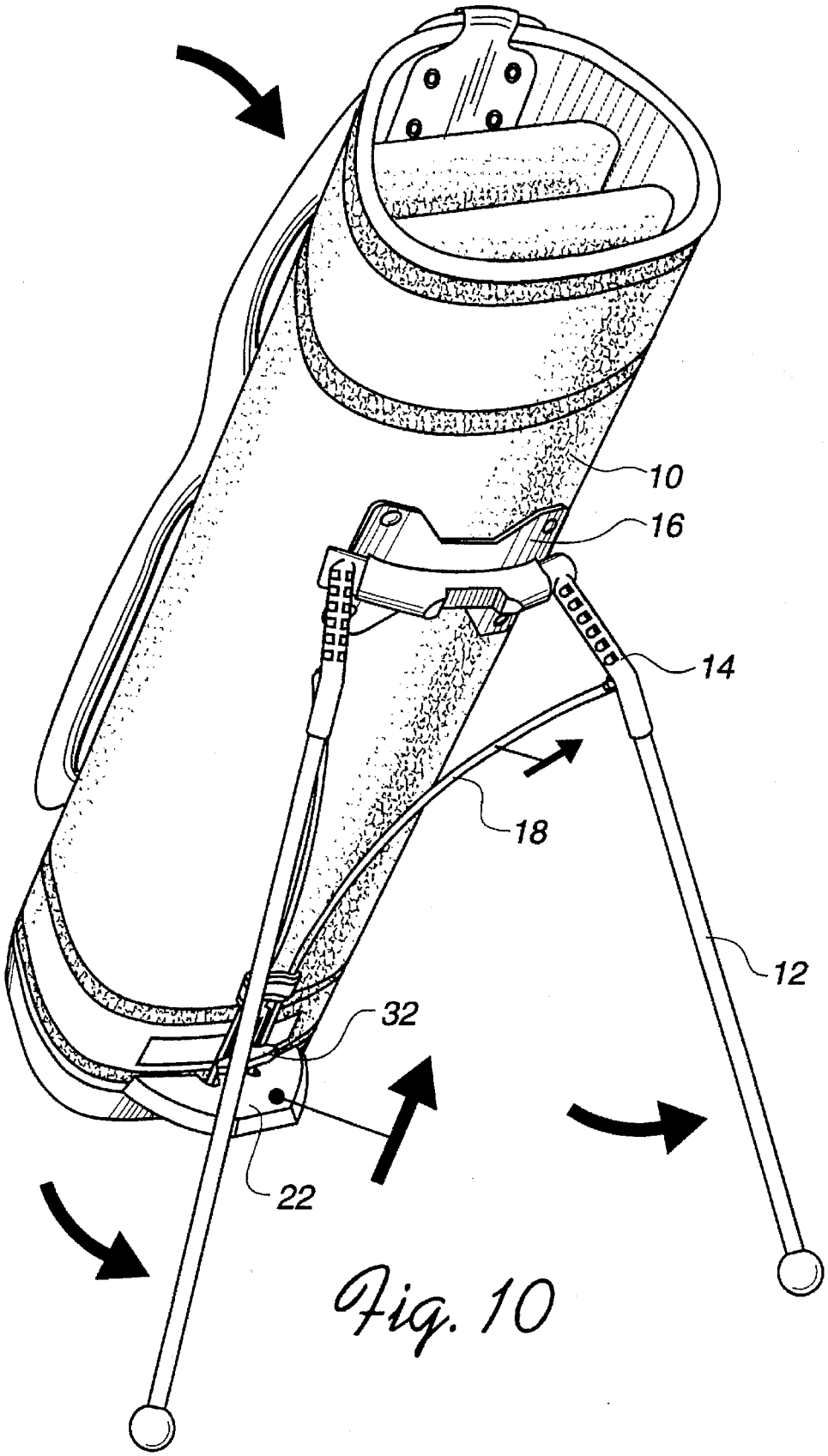

FIG. 2 is an enlarged view of the upper end assembly 16 and the lower T-block 20 and shoe 22 assembly is shown in FIG. 3. The upper end assembly 16 is curved to conform to the curvature of the bag 10 and the assembly has two sockets 24, 25 each comprising straight bores that are angled approximately 120° from each other. The leg castings 14 into which the legs 12 are secured have right angled tubings that enters the sockets 24, 25 and the angled bores therefore permit the legs 12 to pivot forward and outward at an angle of approximately 60° from each other as can be seen in FIG. 10.

Figure 7:
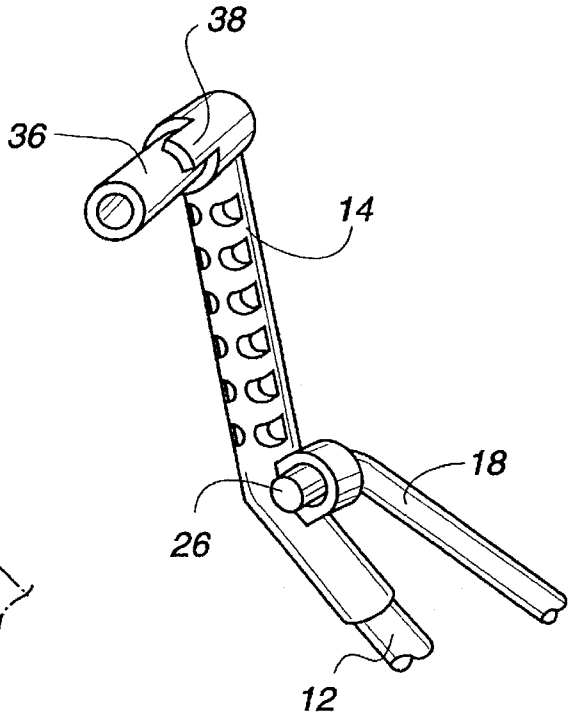
FIG. 7 is a detailed of the upper end of a leg.

The right angled tubings of the leg castings 14 are held in their respective sockets 24, 25 in the upper end assembly 16 by the springs 18 which are sturdy ¼ inch diameter, two foot long rods that are forced outward from their normal parallel position to hook their inward bent tips 26 into rings 27 formed in the castings 14, as shown in FIG. 7. Thus there is always a spring force urging the leg castings into their sockets as long as the springs 18 are hooked to the castings.

The springs 18 are rigidly connected at their lower ends to the shoe 22 are also connected together and held parallel by a clamp 28 which is positioned about four inches above the shoe. Within the space between the two springs 18 and attached to the shoe 22 and the clamp 28 is a slide plate 30 having a central rectangular opening one inch wide and about three inches long. This central opening in the slide plate 30 is positioned to slide behind a T-bar 32 which extends out about ⅜ inch from and is rigidly attached to the T-block 20.

The bottom surface of the shoe 22 is made to be flush with the bottom surface of the golf bag 10 and the T-bar 32 is located near the top of the central rectangular opening in slide plate 30 when the bag is standing vertically as shown in FIG. 1. But when the top of the golf bag is urged forward as shown in FIG. 10, the total weight of the bag and its contents is transfered to the shoe 22. This causes the shoe to rise, causing the springs 18 to rise and thereby forcing the leg castings and legs 12 to pivot outward in their sockets into the position shown in FIG. 10. When the bag is lifted so that weight is no longer on the shoe, the springs 18 attempt to return to their parallel positions and will therefore return the legs bach into the position as shown in FIG. 1.

Figure 6:
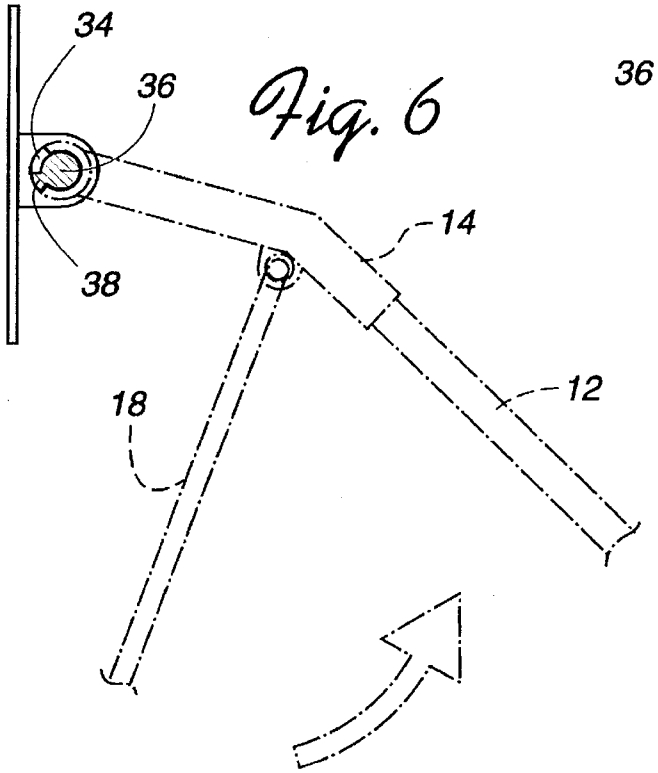
FIG. 6 is a view of the leg socket with leg extended.
Figure 5:
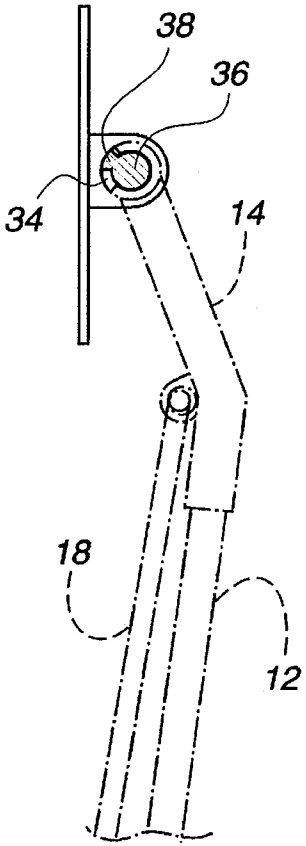
FIG. 5 is a view of the leg socket with leg retracted, taken along the lines 5—5 of the FIG. 2.
Figure 4:
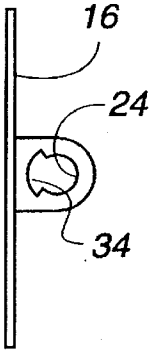
FIG. 4 is a side view of a leg socket at the upper end.

The sockets 24, 25 in the upper end assembly 16 and the tubings in the leg castings that pivot in the sockets are free to pivot but only within certain limits to prevent any overextension of the legs. FIG. 4 is a view of the socket 24 with a larger diameter sector 34 of about 90° forming a keyway. FIG. 5 shows the socket 24 with a tubing 36 of a leg casting 14 having a key 38 that is about half the arcuate length of the keyway sector 34 and positioned at one end of the sector so that the legs 12 may be retracted. FIG. 6 shows the socket 24 with the same key 38 at the opposite end of the keyway sector 34 and the legs 12 extended approximately 45° . Thus, the limits of leg extension is controlled by the keyways in the upper end assembly 16.

Figure 9:
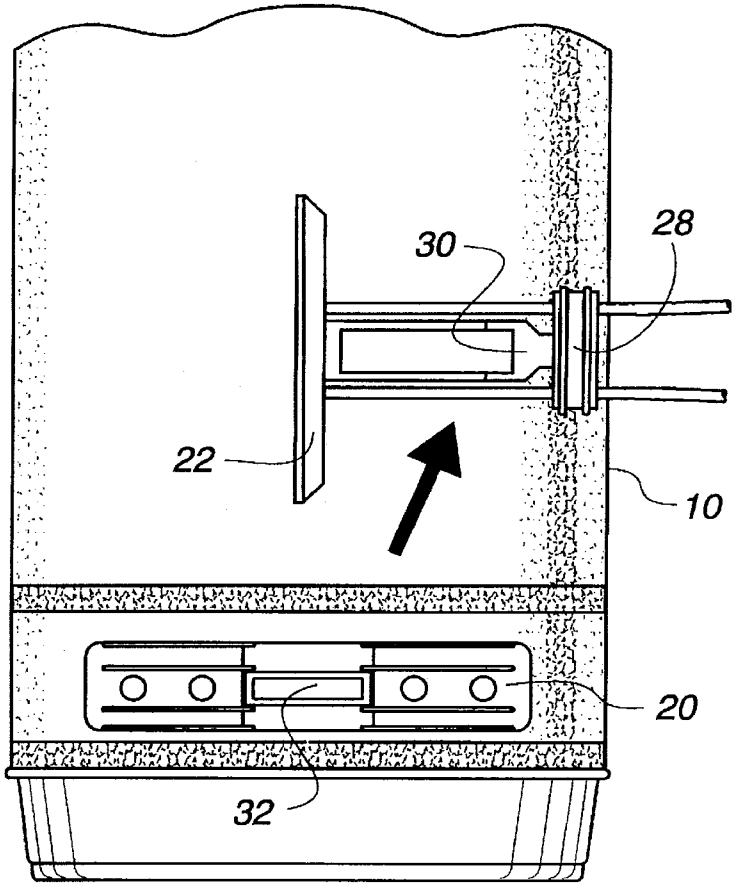
FIG. 9 is a view showing the lower end of the bag after removal of the legs and FIG. 10 is an view of the golf bag with extended tripod legs.
Figure 8:
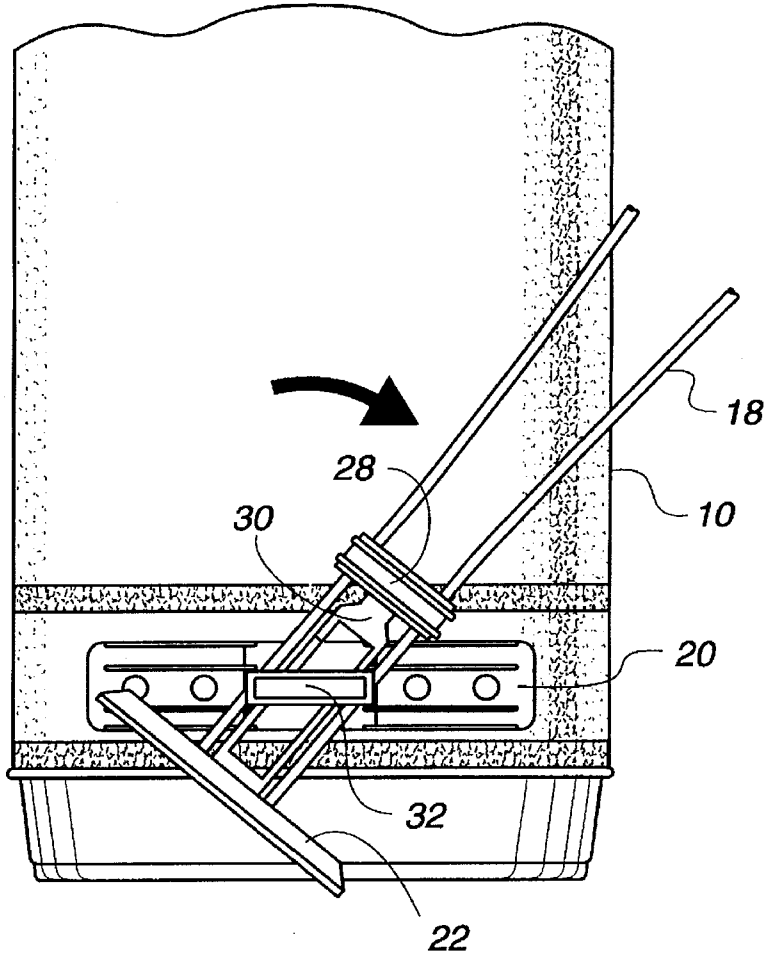
FIG. 8 is a view of the lower end of the tripod legs, showing the removal of the legs.

One of the features of the tripod leg assembly is the ability to rapidly remove and reinstall the legs and springs so that they may be carried or stored in the golf bag. FIG. 7 shows a leg casting 14 with the inward bent tips 26 of the spring 18 hooked to a ring formed in the casting. To remove the legs, it is only necessary to unhook the springs from their respective castings and withdraw the castings from the sockets 24. The springs 18, now released, are then removed as shown in FIGS. 8 and 9. The springs 18, together with their clamp 28, slide plate 30 and the shoe 22 are being held behind the T-bar 32 which is narrower than the one inch wide opening in the slide plate 30. Therefore it is only necessary to tilt the spring assembly, as shown in FIG. 8, until the long axis of the rectangular opening in the slide plate is parallel with the T-bar. The spring assembly is then unlocked from the T-bar and may be removed as shown in FIG. 9. To reassemble the tripod legs, the process is reversed, each taking about ten seconds.

We claim:

1. In combination with a golf bag having an upper end and a lower end, an automatically extendible leg assembly comprising:

a leg socket unit attached to said golf bag near its upper end, said leg socket unit having two tubular outward facing, spaced sockets having axes parallel with the upper end of said bag, said axes being at an angle less than 160° from each other;

a T-bar attached to said bag near the lower end thereof and directly beneath said leg socket unit, said T-bar extending out from the surface of said bag, a bar of said T-bar being parallel with the lower end of said bag;

a pair of legs having a length approximately equal to the space between said leg socket unit and said T-bar, each leg of said pair of legs having at one end a tubular end at right angles to said leg for pivoting in one of said two outward facing sockets, each leg of said pair of legs having a loop located approximately three inches below said tubular ends;

a pair of normally parallel spring rods each bent at a first end and hooked into the loop on one end of said pair of legs, near a second end said pair of spring rods being clamped together and positioned for sliding between said T-bar and said bag, said pair of spring rods being joined together at an end below said T-bar at the lower end of said bag;

a shoe coupled to the joined ends of said pair of spring rods, said shoe extending from the side surface of said golf bag and having a bottom surface that is flush with the lower end of said golf bag, whereby tilting of said golf bag forces said shoe to raise and causes said pair of spring rods to force said pair of legs to pivot outward from said tubular sockets a predetermined amount to form a tripod with said bag as one leg;

said predetermined amount of pivoting being limited by a key on each of said tubular ends of each one of said pair of legs and a keyway in a bore of each of said outward facing sockets in said leg socket unit, said key being a segment having a larger diameter than said tubular ends with an approximate arcuate length of half the arcuate length of said keyway in the bore of each one of said outward facing sockets.

2. The combination claimed in claim 1 wherein said two outward facing sockets have axes parallel with the upper end of said golf bag and are at an approximate angle of 120° to each other.

3. The combination claimed in claim 1 wherein said pair of legs are removable by removing said spring rods from said loops and removing said pair of legs, said pair of spring rods being removable from said bag by rotating said pair of springs rods with said shoe 90° to release said pair of spring rods from said T-bar.

* * * * *